US008875942B2

(12) United States Patent
Poliner

(10) Patent No.: US 8,875,942 B2
(45) Date of Patent: Nov. 4, 2014

(54) SIDE-GRIP METHOD FOR GRASPING TEXTILE ITEMS IN A VENDING MACHINE

(75) Inventor: Tomer Poliner, Hadera (IL)

(73) Assignee: Polytex Technologies Ltd., Hadera (IL)

( * ) Notice: Subject to any disclaimer, the term of this patent is extended or adjusted under 35 U.S.C. 154(b) by 269 days.

(21) Appl. No.: 13/419,541

(22) Filed: Mar. 14, 2012

(65) Prior Publication Data

US 2012/0234853 A1 Sep. 20, 2012

Related U.S. Application Data

(60) Provisional application No. 61/452,182, filed on Mar. 14, 2011.

(51) Int. Cl.

| | |
|---|---|
| ***G07F 11/14*** | (2006.01) |
| ***G07F 11/16*** | (2006.01) |
| ***G07F 11/04*** | (2006.01) |

(52) U.S. Cl.

CPC ..... *G07F 11/14* (2013.01); *G07F 11/165* (2013.01); *G07F 11/045* (2013.01)

USPC ..... 221/210; 221/220

(58) Field of Classification Search

CPC ..... G07F 11/165; G07F 11/045; G07F 11/62; G07F 11/14; G07F 11/16

USPC ..... 221/210, 220, 213, 133

See application file for complete search history.

(56) References Cited

U.S. PATENT DOCUMENTS

| | | | | |
|---|---|---|---|---|
| 3,042,172 | A * | 7/1962 | Bowlby | 221/210 |
| 4,787,533 | A * | 11/1988 | Haroutel et al. | 221/211 |
| 5,996,840 | A * | 12/1999 | Serduke | 221/210 |
| 7,474,938 | B2 * | 1/2009 | Poliner | 700/242 |
| 7,513,089 | B2 * | 4/2009 | Rubin | 221/132 |

FOREIGN PATENT DOCUMENTS

| | | |
|---|---|---|
| AU | WO2004034342 | 4/2004 |
| EP | 2378495 | 10/2011 |
| FR | 2737398 | 2/1997 |
| IL | WO2004086165 | 10/2004 |

* cited by examiner

*Primary Examiner* — Timothy Waggoner
(74) *Attorney, Agent, or Firm* — Mark M. Friedman

(57) ABSTRACT

A side-grip method of grasping and moving textile items in a vending machine from the storage area to the dispensing chute that does not require the textile item to be packaged comprising: (a) providing a stack of folded and unwrapped textile items; (b) providing an article selection mechanism configured with a gripping element; (c) vertically displacing said gripping element until said gripping element reaches a level of a top textile item in said stack; and (d) closing said gripping element solely on said textile item. Disclosed also is a vending machine configured to implement such a method.

11 Claims, 8 Drawing Sheets

SIDE-GRIP METHOD FOR GRASPING TEXTILE ITEMS IN A VENDING MACHINE

FIELD AND BACKGROUND OF THE INVENTION

The present invention relates to moving textile items in a vending machine from the storage area to the dispensing chute and, in particular, it concerns a side-grip method for grasping the textile items.

It is current practice in the art of vending machines configured for dispensing garments and other textile items to package the item. Packaging keeps the textile item contained during the transfer for the storage area to the dispensing chute. While this simplifies the dispensing process, it adds time and expense to the overall vending process in the form of cost of the packaging used and the time require to insert the item into the package.

There is therefore a need for a side-grip method of grasping and moving textile items in a vending machine from the storage area to the dispensing chute that does not require the textile item to be packaged and a device configured to implement such a method.

SUMMARY OF THE INVENTION

The present invention is a side-grip method of grasping and moving textile items in a vending machine from the storage area to the dispensing chute that does not require the textile item to be packaged and a device configured to implement such a method.

According to the teachings of the present invention there is provided, a side-grip method of grasping and moving textile items in a vending machine from the storage area to the dispensing chute that does not require the textile item to be packaged, the method comprising: (a) providing a stack of textile items; (b) providing an article selection mechanism configured with a gripping element; (e) vertically displacing the gripping element until the gripping element reaches a level of a top textile item in the stack; and (d) grasping the textile item with the gripping element proximate to an edge of the textile item.

According to a further teaching of the present invention, the textile item is folded at least one time.

According to a further teaching of the present invention, the textile item is unwrapped.

According to a further teaching of the present invention, the gripping element grasps only the textile item.

According to a further teaching of the present invention, the gripping element grasps the textile item on at least a portion of an edge.

According to a further teaching of the present invention, the gripping element grasps at least a portion of a top surface of the textile item in proximity to an edge of the textile item.

According to a further teaching of the present invention, the gripping element is implemented with a support arm 14 for securing the textile item 20*t* between the gripping element 12 and the support arm 14.

There is also provided according to the teachings of the present invention, a vending machine for dispensing chute that does not require the textile item to be packaged, the vending machine comprising: (a) a stack 20 of textile items; and (b) an article selection mechanism 10 configured with a vertically displaceable gripping element 12; wherein the vertically displaceable gripping element 12 is configured for gripping a top item 20*t* in the stack 20 proximate to an edge of the textile item 20*t*.

According to a further teaching of the present invention, the textile item 20*t* is deployed in the vending machine in a folded state being folded at least one time.

According to a further teaching of the present invention, the textile item 20*t* is deployed in the vending machine in an unwrapped state.

According to a further teaching of the present invention, the gripping element 12 grasps only the textile item.

According to a further teaching of the present invention, the gripping element is configured to grasps the textile item 20*t* on at least a portion of an edge 2.

According to a further teaching of the present invention, the gripping element is implemented with a support arm 14 for securing the textile item 20*t* between the gripping element 12 and the support arm 14.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a side-grip method of grasping and moving textile items in a vending machine from the storage area to the dispensing chute that does not require the textile item to be packaged.

The principles and operation of a side-grip method of grasping and moving textile items in a vending machine according to the present invention may be better understood with reference to the drawings and the accompanying description.

By way of introduction, it should be understood that the current state of the art requires that textile items be dispensed in a vending machine are deployed in some kind of packaging such as metal/plastic cans, bag-like wrappers and bands that surround at least a portion of the item. An innovation of the present invention is to provide both a method and a system for dispensing a textile item that does not require the textile item to be packaged, thereby saving the time and expense for placing the textile item in a package suitable of interaction with the vending machine to be used to dispense it. That is to say, the vending machine of the present invention is able to dispense textile items that are not deployed in any kind of package or wrapper and are merely stacked one on another. In some situations, the textile item may be deployed in the stack in a folded arrangement. However, in all situations in which the textile items are deployed in the vending machine in an unwrapped state, the gripping element 12 of the article selection mechanism 10 is gripping only the textile item itself and not a package or wrapper in which the textile item is deployed. That said, it will be appreciated that the method of the present invention may be used to equally benefit with items that are deployed in the vending machine in a wrapper or package.

Figure 1:
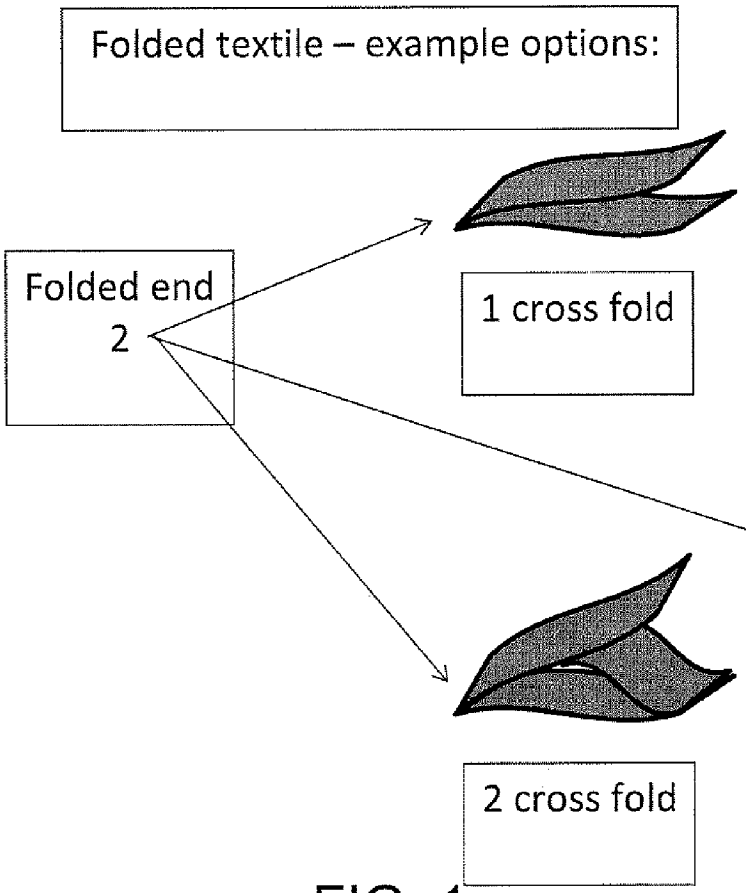
FIG. 1 is a schematic view of two preferred options for the manner in which the textile items are folded.

Referring now to the drawings, FIG. 1 illustrates two different options for folding the textile items according to the present invention. While FIG. 1 illustrates the item to be folded once (in half) or twice (in thirds), this is clearly intended as a non-limiting example and the manner in which the item is folded, if at all, is determined by the size of the textile item and the size of the storage area in which the item will be stored in the vending machine. Therefore, small items such as, but not limited to, hand towels may not be folded at all. Since each folded item may contain none or more than one folded edge, the term "folded edge 2" is used herein to refer to the edge of the textile item that is facing the article selection mechanism 10.

FIGS. 2-6 illustrate an article selection mechanism 10 and a stack of textile items 20, during the item selection process of the side-grip method of the present invention.

Figure 2:
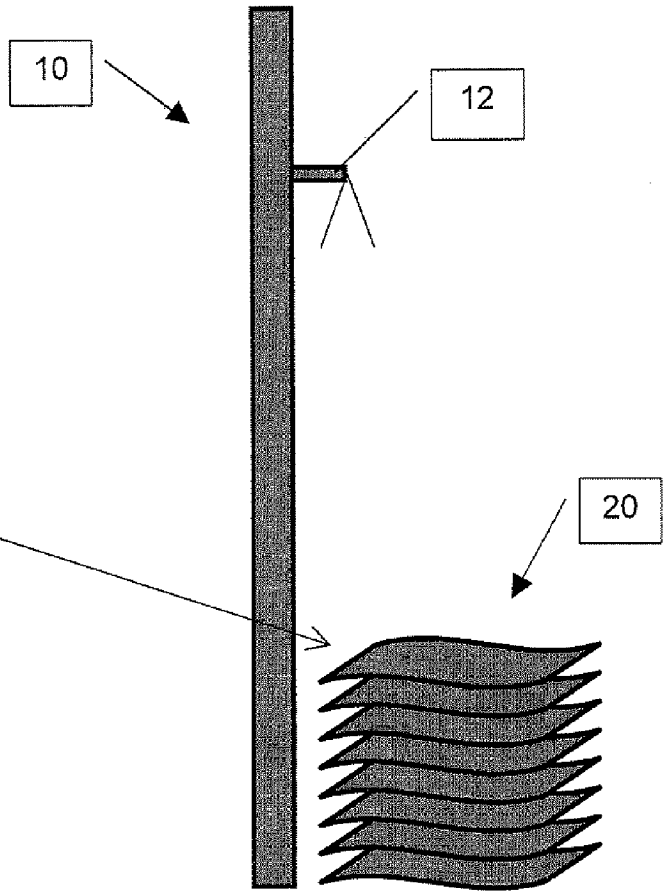
FIGS. 2-6 are schematic side views of an article selection mechanism, constructed and operational according to the teachings of the present invention, and a stack of textile items, this series of drawings illustrating a first preferred side-grip method of the present invention during the item selection process.
Figure 7:
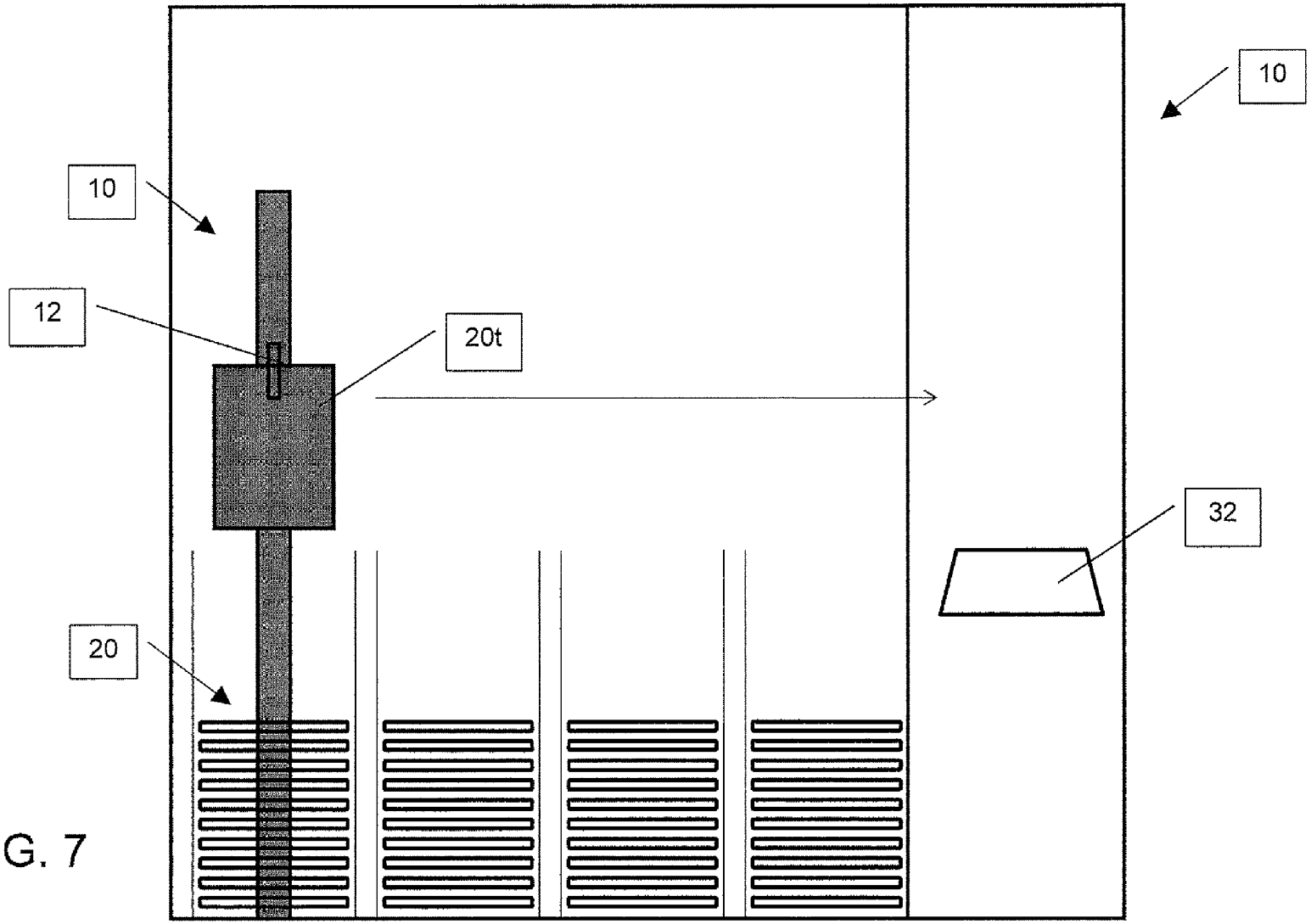
FIGS. 7-9 are schematic transparent front views of a vending machine constructed and operational according to the teachings of the present invention configured for vending textile items using the method of the present invention, this series of drawings illustrating the side-grip method of the present invention as the textile item is moved from the storage stack to the dispensing chute.
Figure 8:
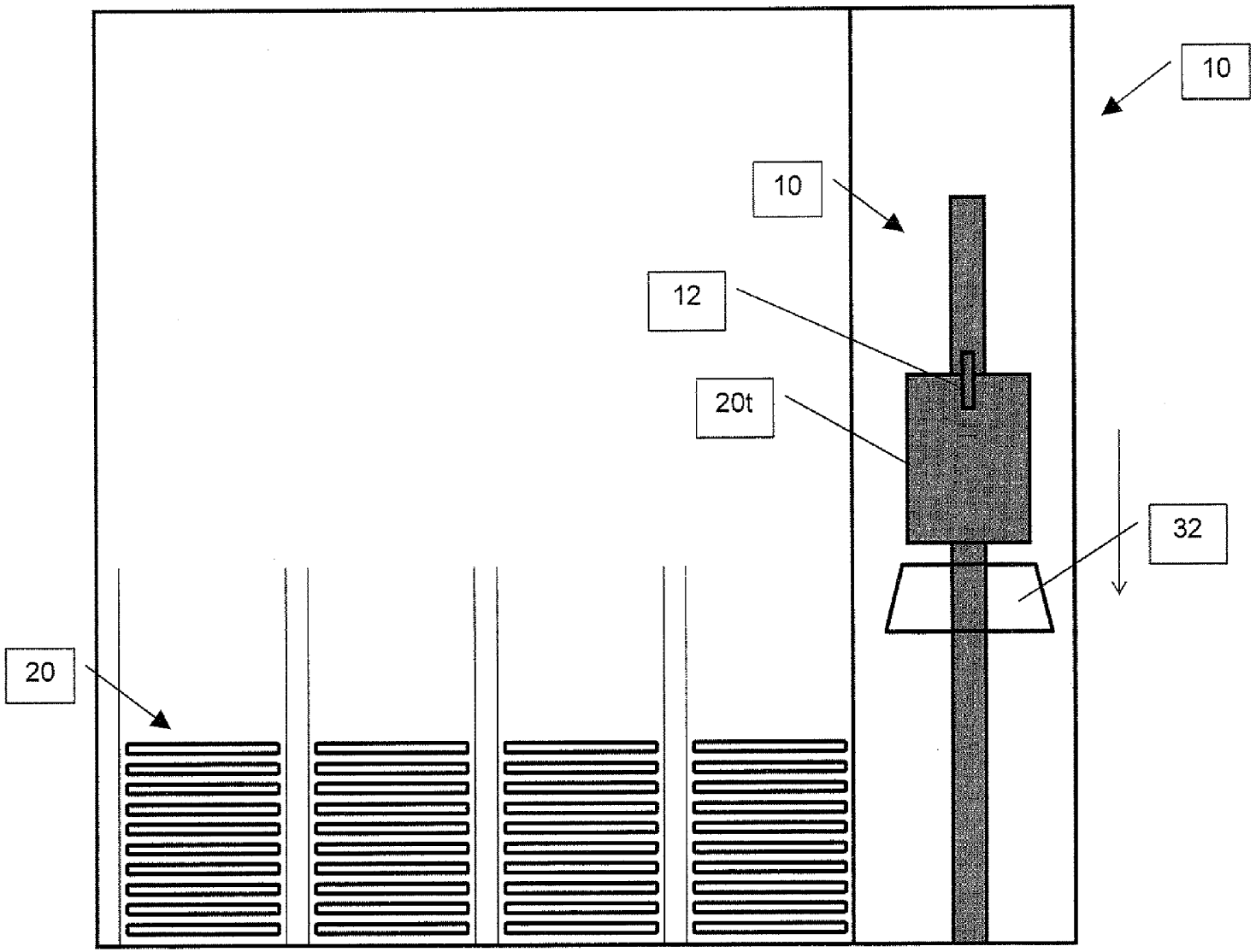
Figure 9:
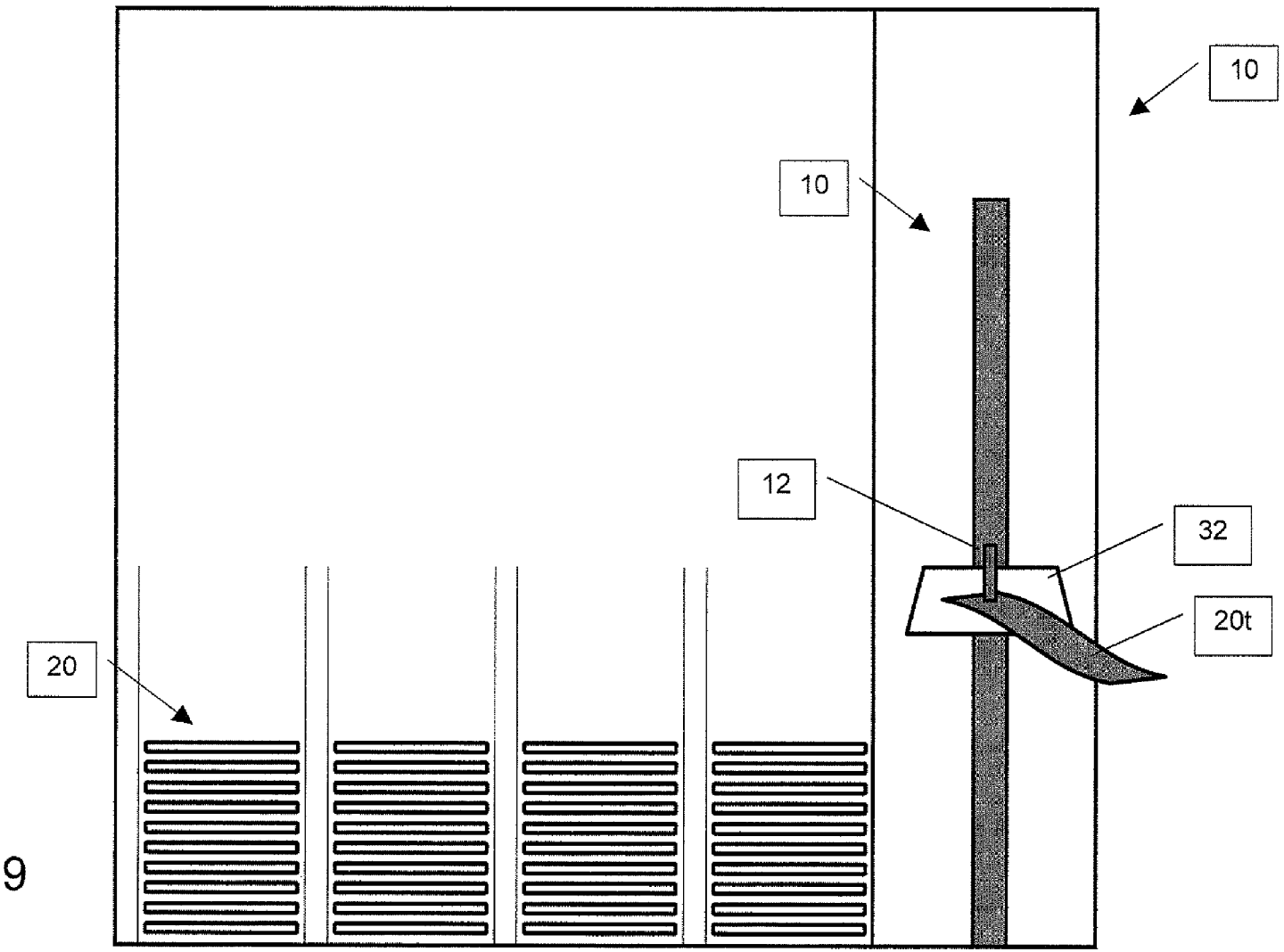
Figure 11:
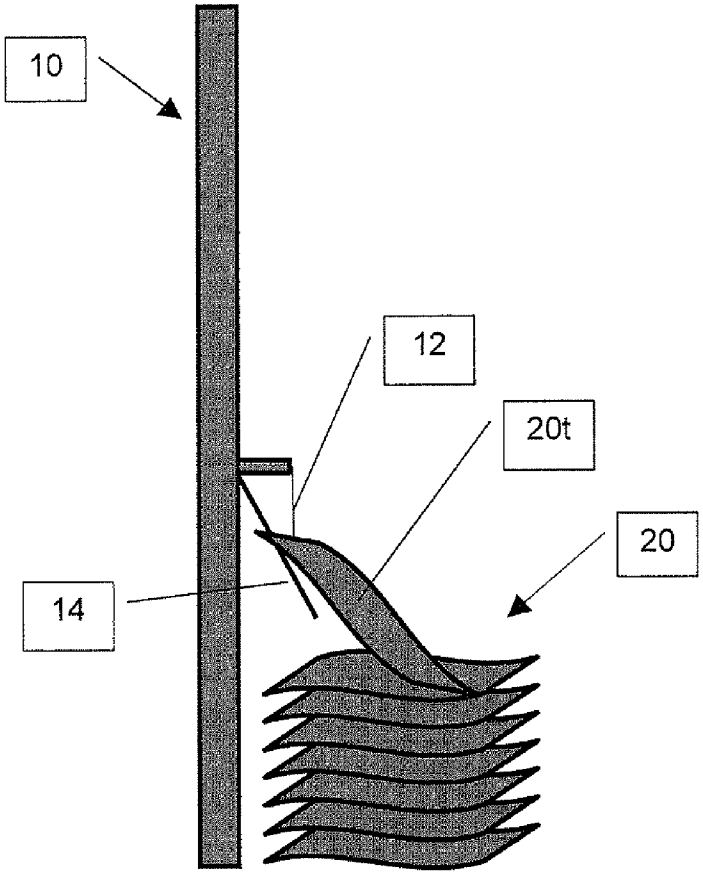
FIGS. 10-12 are schematic side views of an alternative article selection mechanism constructed and operational according to the teachings of the present invention, and a stack of textile items.
Figure 10:
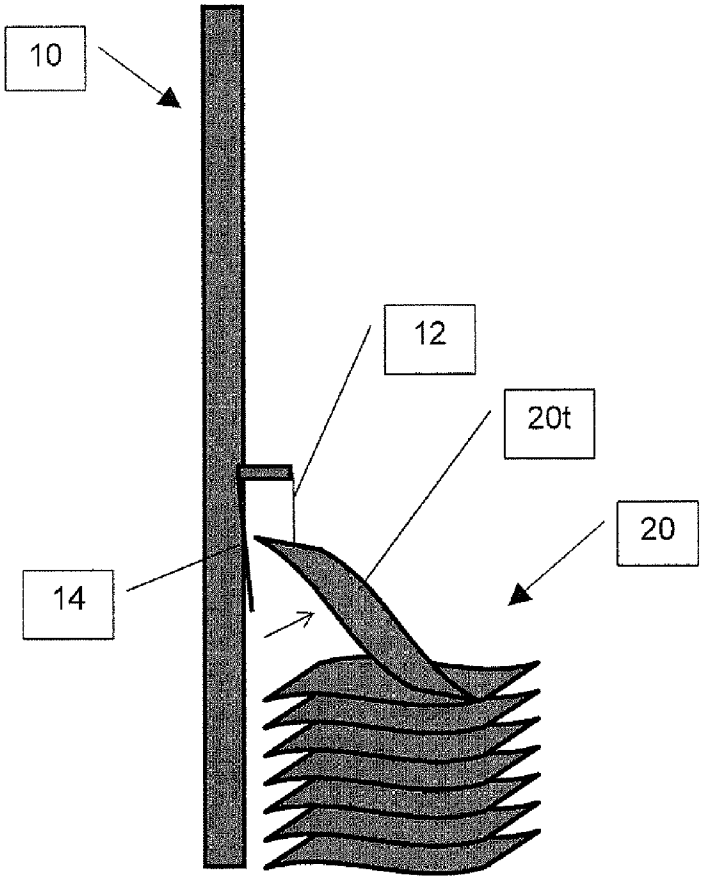
Figure 12:
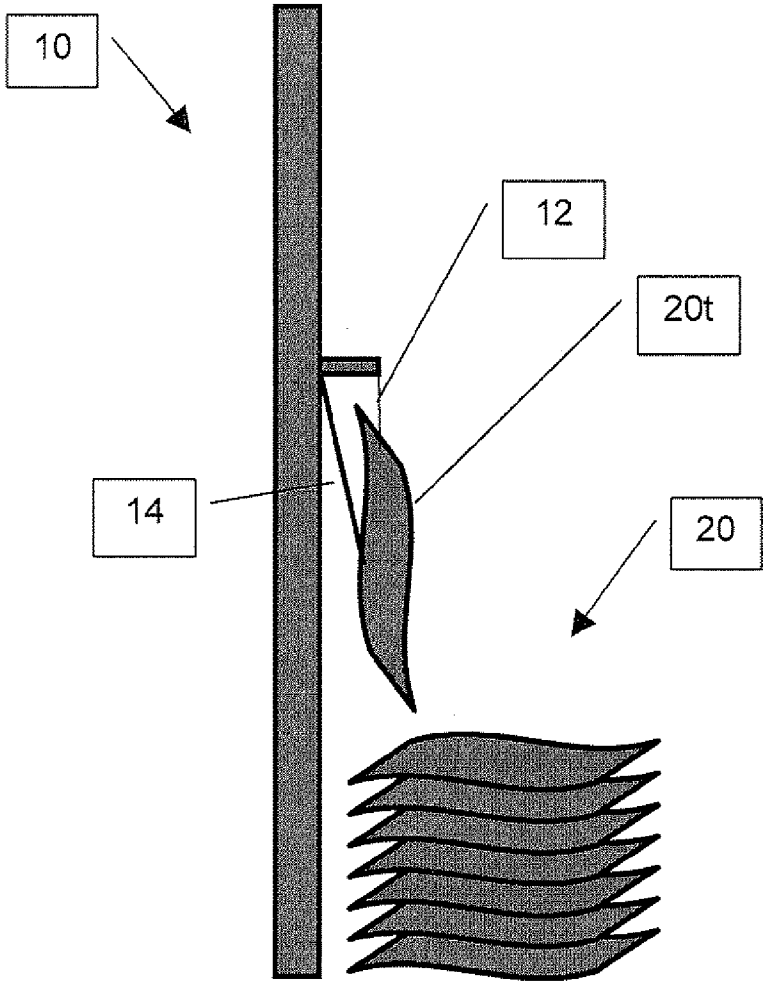

In FIG. 2, the article selection mechanism 10 is a rest. It should be noted that the article selection mechanism 10 is deployed in an area behind the storage area in which the stack 20 of textile items is stored. Thusly deployed, the article selection mechanism 10 is freely displaceable along the full length of the vending machine 30 (FIGS. 7-9). However, this is not intended as a limitation and it will be appreciated that the article selection mechanism may also be deployed so as to access the stack of textile items from either the side or the front of the stack as well.

Figure 3:
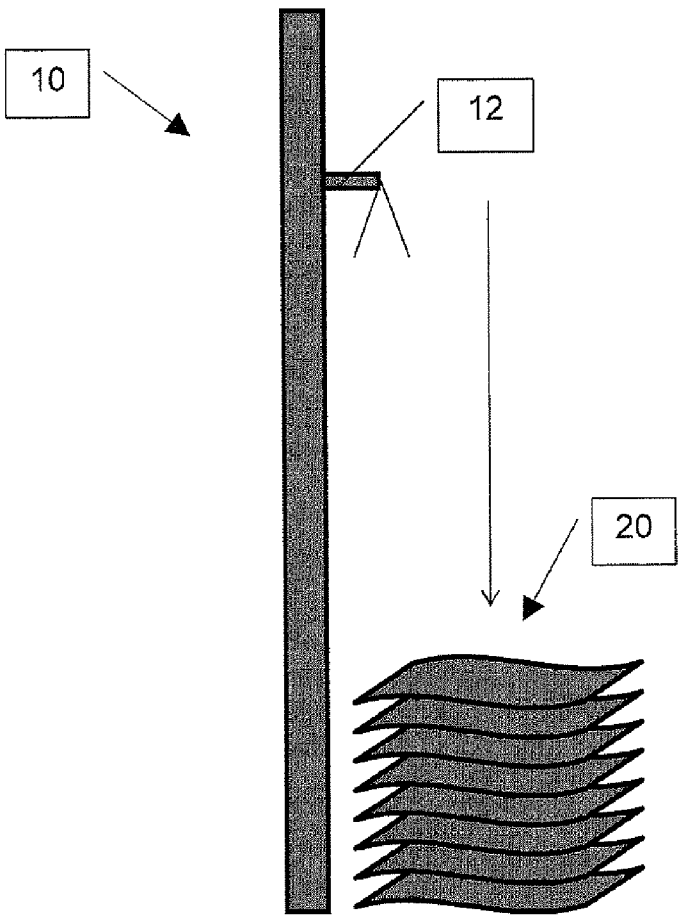

In FIG. 3, the gripping element 12 of the article selection mechanism 10 is displaced vertically. As illustrated here, the gripping element 12 is lowered.

Figure 4:
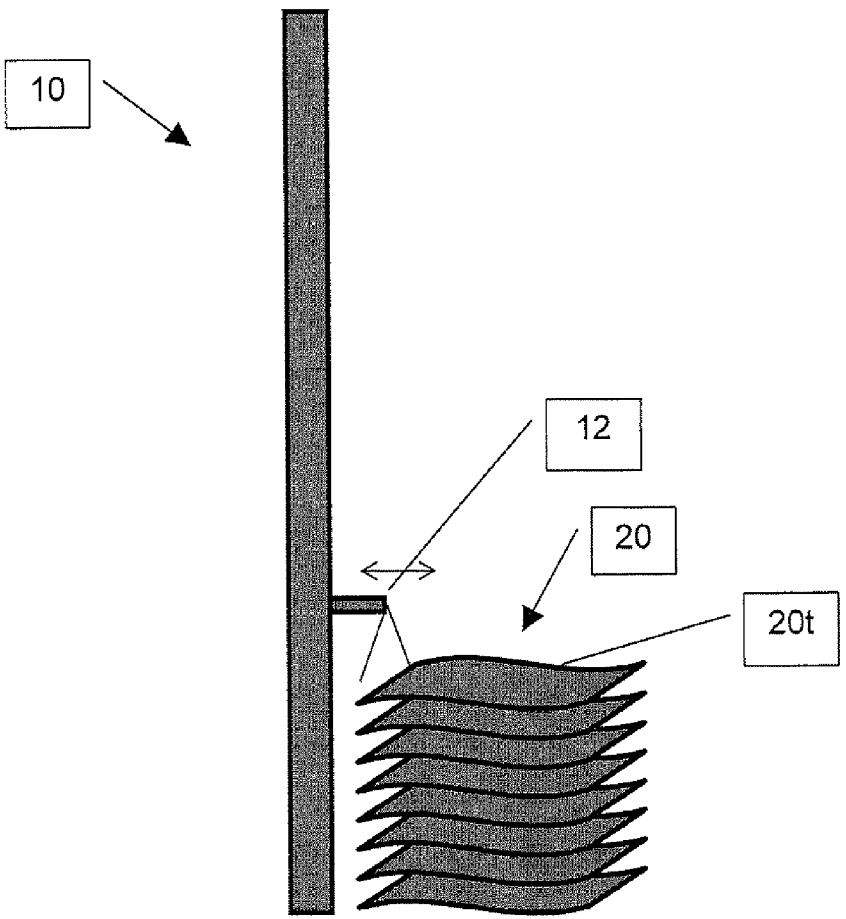

In FIG. 4, once the gripping element 12 has reached the level of the top item 20*t* in the stack 20 the gripping element 12 may be, but not necessarily displaced horizontally as necessary for alignment with the folded edge 2 of the textile item 20*t*.

Figure 5:
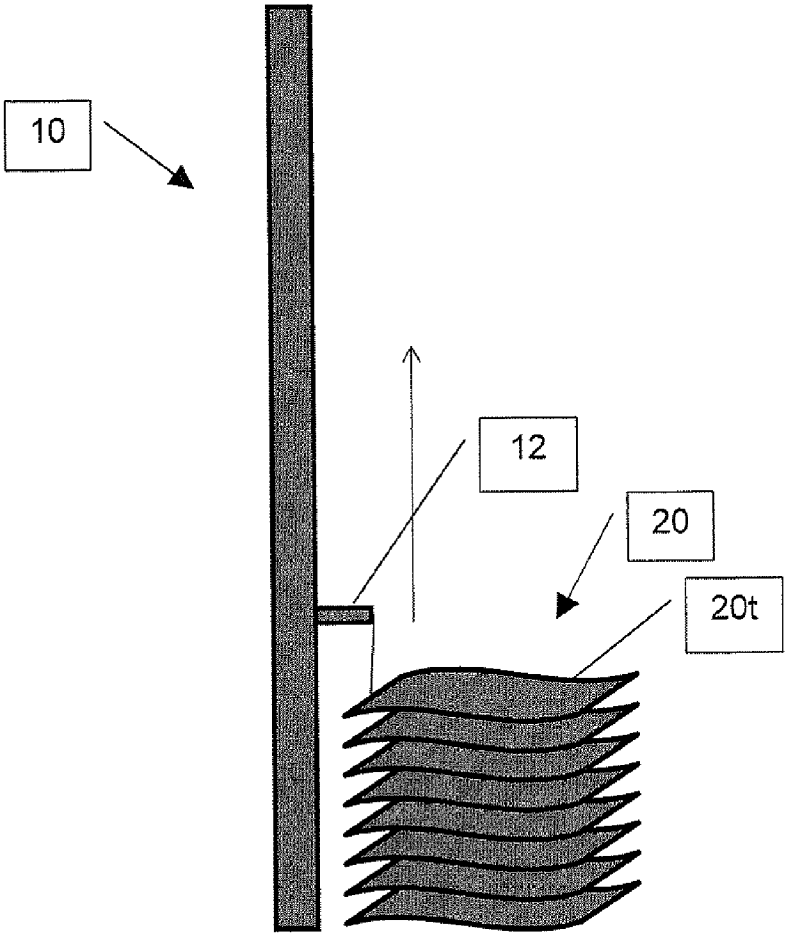

As illustrated in FIG. 5, once the gripping element 12 is aligned with the folded edge 2 of the textile item 20*t*, the gripping element 12 grasps at least a portion of the textile item 20*t*. It will be appreciated that the gripping element may be configured to grip the textile item along the folded edge 2 (i.e., closing on both the top and bottom surfaces of the folded item), or to grip only a portion of the top surface of the item 20*t* in proximity to the folded edge 2. It should be noted that the illustration herein of "gripping fingers" is for illustration purposes only and is not intended as a limitation. Rather, substantially any suitable gripping means is within the scope of the present invention.

Figure 6:
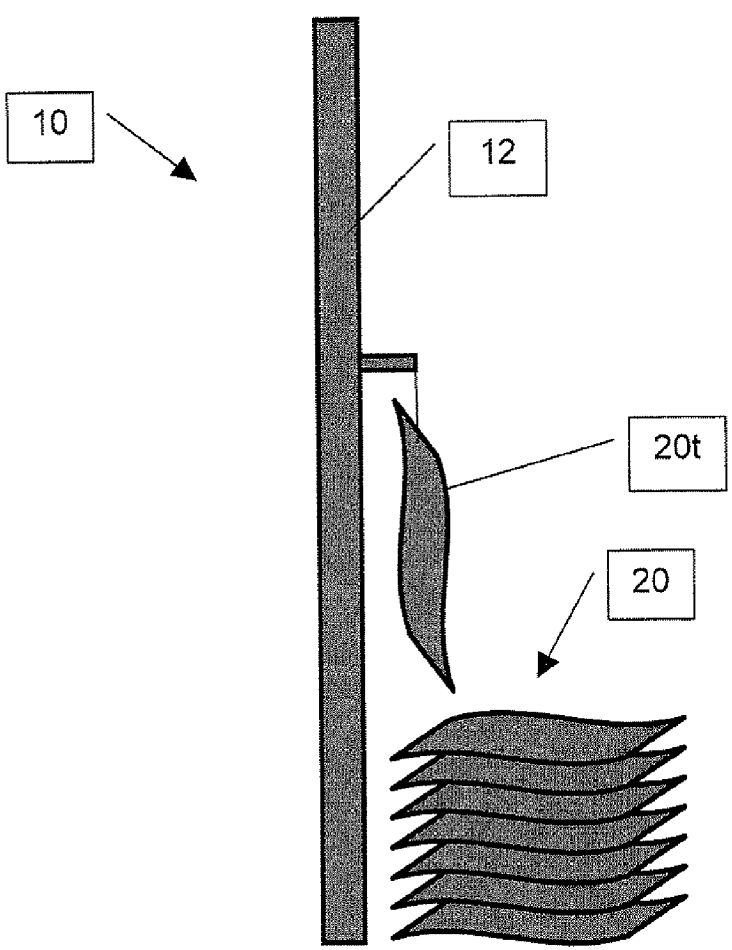

In FIG. 6, the gripping element 12 of the article selection mechanism 10 is again displaced vertically. As illustrated here, the gripping element 12 is raised. As the gripping element 12 is raised, the textile item 20*t* is also raised and hangs from the gripping element 12.

FIG. 7, is a front view of FIG. 6, now showing the full vending machine 30 which includes a dispensing chute 32. It should be noted that the location of the dispensing chute 32 illustrated herein is intended as a non-limiting example only and that the deployment of dispensing chute 32 may be at substantially any suitable location in the vending machine 30.

As illustrated in FIG. 8, the article selection mechanism 10 is displaced horizontally behind the storage bins in which the stacks of textiles are stored until the gripping element 12, from which the textile item 20*t* is hanging, is aligned with the dispensing chute 32.

In FIG. 9, the gripping element 12 is lowered as the textile item 20*t* is aligned with, and dispensed through, the dispensing chute 32.

As mentioned above, the gripping element 12 may be configured to grip the textile item along at least a portion of the folded edge 2 (i.e., closing on both the top and bottom surfaces of the folded item), or to grip only at least a portion of the top surface of the item 20*t* in proximity to the folded edge 2. It has been found that when some garments are gripped on the top surface of the item in proximity to the folded edge 2, some textile item becomes at least partially unfolded when subsequently raised along with the gripping element 12.

To solve this problem, alternatively or optionally, a support arm 14 is added to the gripping element 12. Support arm 14 is configure to be displaced as the textile item 20*t* is raised by the gripping element 12 and secure the textile item 20*t* between the gripping element 12 and the support arm 14. In such a deployment, the support arm 14 supports the bottom/back surface of the folded textile item 20*t* while confining the folded textile item 20*t* between the gripping element 12 and the support arm 14. Such support has been found to prevent the textile item 20*t* from unfolding as it is transported to the dispensing chute 32.

It will be appreciated that the above descriptions are intended only to serve as examples and that many other embodiments are possible within the spirit and the scope of the present invention.

What is claimed is:

1. A side-grip method of grasping and moving textile items in a vending machine from the storage area to the dispensing chute that does not require the textile item to be packaged, the method comprising:

(a) providing a stack 20 of textile items;

(b) providing an article selection mechanism 10 configured with a gripping element 12;

(c) vertically displacing said gripping element 12 until said gripping element 12 reaches a level of a top textile item 20*t* in said stack 20; and (d) grasping said textile item 20*t* with said gripping element 12 on at least a portion of an edge of said textile item 20*t* as said textile lies on said stack.

2. The method of claim 1, wherein said textile item 20*t* is folded at least one time.

3. The method of claim 1, wherein said textile item 20*t* is unwrapped.

4. The method of claim 3, wherein said gripping element 12 grasps only said textile item.

5. The method of claim 1, wherein said gripping element 12 grasps at least a portion of a top surface of said textile item 20*t* in proximity to an edge 2 of the textile item 20*t*.

6. The method of claim 1, wherein said gripping element is implemented with a support arm 14 for securing said textile item 20*t* between said gripping element 12 and said support arm 14.

7. A vending machine for dispensing chute that does not require the textile item to be packaged, the vending machine comprising:

(a) a stack 20 of textile items; and (b) an article selection mechanism 10 configured with a vertically displaceable gripping element 12;

wherein said vertically displaceable gripping element 12 is configured for gripping a top item 20*t* in said stack 20 on at least a portion of an edge of said textile item 20*t* as said textile lies on said stack.

8. The vending machine of claim 7, wherein said textile item 20*t* is deployed in the vending machine in a folded state being folded at least one time.

9. The vending machine of claim 7, wherein said textile item 20*t* is deployed in the vending machine in an unwrapped state.

10. The vending machine of claim 9, wherein said gripping element 12 grasps only said textile item.

11. The vending machine of claim 7, wherein said gripping element is implemented with a support arm 14 for securing said textile item 20*t* between said gripping element 12 and said support arm 14.

* * * * *